US005325783A

United States Patent [19]

Wong

[11] Patent Number: 5,325,783

[45] Date of Patent: Jul. 5, 1994

[54] PROPELLANT FORMULATION AND PROCESS

[75] Inventor: James Wong, Wayland, Mass.

[73] Assignee: Composite Materials Technology, Inc., Shrewsbury, Mass.

[21] Appl. No.: 415,926

[22] Filed: Sep. 21, 1989

Related U.S. Application Data

[63] Continuation-in-part of Ser. No. 269,884, Nov. 10, 1988.

[51] Int. Cl.[5] ..... C06B 45/00

[52] U.S. Cl. ..... 102/289; 102/290; 149/37

[58] Field of Search ..... 149/37, 38; 102/289, 102/290

[56] References Cited

U.S. PATENT DOCUMENTS 3,784,419 1/1974 Baumann et al. ..... 149/2

4,764,229 8/1988 Miekka et al. ..... 149/2 X

*Primary Examiner*—Peter A. Nelson

*Attorney, Agent, or Firm*—Hayes, Soloway, Hennessey, Grossman & Hage

[57] ABSTRACT

The present invention relates to metal filaments for use as fuel additives for rocket propellants, explosives, and other pyrotechnic devices. Preferred filaments are those such as zirconium, niobium and titanium (and alloys thereof) which have very high heat of combustion.

7 Claims, No Drawings

PROPELLANT FORMULATION AND PROCESS

This application is a continuation-in-part application of my copending application Ser. No. 269,884 filed Nov. 10, 1988 and still pending..

The present invention relates to metal filaments for use as fuel additives for rocket propellants, explosives, and other pyrotechnic devices. Preferred filaments are those such as the reactive metals zirconium, niobium, titanium and Hafnium (and alloys thereof) which have very high heat of combustion.

BACKGROUND

In rocket propellants, grenades, and various explosive devices, metal powders are often added to increase the overall heat of combustion and otherwise control the rate of burning of a propellant or explosive. (For example, "Metal Powders for Fuel Propellant, Pyrotechnics, and Explosives" Fauth, pp 597–605, and "Explosivity and Pyrophoricity of Metal Powders" Dahn, pp 194–200, ASM Handbok Vol. 7, 1984. ) While zirconium and similar powders have been employed in the past, they are extremely hazardous to use due to the pyrophoricity of zirconium powders and the tremendous heat generated by the burning of such powders. Known techniques for producing such zirconium powders involve reduction processes which provide a fairly wide range of particle sizes, some of which can be extremely fine and almost impossible to handle under conditions other than completely inert ambient atmospheres. Also, the wide range of particle sizes which result from most processing operations can give undesirable burning characteristics which are more difficult to predict and control. The normal methods for the formation of powders involve continued mechanical diminution (i.e. grinding, ball milling, impact crushing, etc.) all produce particles which are extremely nonuniform, irregular and contaminated. These methods often form "dust" (e.g. airborne sub particles). This is the nature of these processes. The powder becomes more dangerous to handle as the particles get smaller, and the degree of surface contamination also increases, resulting in variability in ignition and spontaneous combustion problems. Due to the fact that sub micron powders are subject to agglomeration the actual surface area could be considerably larger than if we assume the particles are separate solid spheres and thus create unpredictable performance.

The most common metal used is Aluminum as an addition to solid rocket propellant and explosive devices. The amount of Aluminum can be up to 20% of the total charge. Other metals are also used and these are Magnesium, Titanium and Zirconium. These metals are generally added in form of very fine particles or powders. In most cases however, the full utilization of the theoretical performance of these metal additions has not been achieved for a variety of reasons. In general, the main factors which govern the performance are the same parameters which control the ignition and subsequent combustion of the metal particles. The rate of combustion can vary from burning (Deflagration) to very rapid detonation of the metal as in explosives. These factors are:

1. Size and shape of the metal in fine dispersion.
2. Surface area/volume ratio.
3. Chemical purity of the bulk metal and its surface.
4. The real and apparent density of the metal.
5. Surface contamination resulting from processing or for safety reasons.
6. Nature of the prepared surface which relates to the method of preparation . . . i.e. made by ball milling, grinding or various chemical or electro-chemical methods.
7. The physical properties such as melting point (in the case of Aluminum, the low melting point results in both particle agglomeration and melting prior to ignition and combustion).

Considerable attention has been spent on optimization of the fuel, oxidizer and binder portions of rocket and explosive devices. In all cases, the metal addition has not received similar attention. As a result, what has been available has been essentially what the powder metallurgy industry can produce and this has resulted in less than desired performance. The following are the most desirable characteristic for metal fuel additions:

1. Metals which are uniform in both size and shape such that reliable reproducible ignition and complete combustion can take place.
2. The metal should be produced in very fine state of dispersion.
3. The metal should be completely dense and not porous or agglomerated powders.
4. The surface of the bulk metal should be of high purity, free of contaminants.
5. Very little size variation to minimize the danger of handling and processing.
6. The metal can be manufactured economically and safely in large quantities.

SUMMARY OF THE PRESENT INVENTION

In the present invention the disadvantages of metal powders, such as zirconium, used in the past for additives to fuel propellants and explosives are overcome by providing elongated cylindrical metal particles having essentially uniform filament diameters. These particles have very predicable surface area to volume ratios which are independent of particle length (at length to diameter ratios in excess of 1,000) and dependent only on cylinder diameter. In the use of solid finely dispersed powders, one assumes that the main variable that is important, in ignition and combustion of the powder particles, is the surface area to volume ratio. This means that as the particles are reduced in size, the surface to volume ratio also increases. As the particle size decrease, and when the particles are exposed to atmosphere $O_2$ and $N_2$, surface reaction occurs with heat being generated. If this heat is not dissipated, spontaneous combustion can occur. In much the same way ignition and subsequent combustion occurs in rocket fuels and explosives.

As a first approximation of the surface area to volume ratio of powder particle we can assume a solid sphere. The surface area to volume ratio for both a solid sphere and that of a filament can be compared: Taking this ratio, the following relationship can be proven.

$$\frac{6}{Ds} - \frac{4}{Df} + \frac{2}{\text{Length of Filament}}$$

(Where Ds is the Diameter of a sphere and Df is the diameter of the filament.)

For lengths which are many times longer than the diameter (e.g. 1,000 times) the surface to volume relationship is essentially:

$$Df = \frac{2}{3}Ds$$

Thus a filament diameter has only to be $\frac{2}{3}$ that of a sphere to give the same surface area/volume ratio.

Note that a sphere has minimum surface for a given volume; thus a cylinder or filament has more surface for the same volume. Thus a 3 micron particle has the same ignition and combustion properties as a 2 micron filament.

While it is preferred that the elongated particles be essentially cylindrical in cross section, they may have other cross sectional shapes, such as hexagonal, eliptical, or partially flattened. In any case, the particles should be uniform, having predictable and controlled surface to volume ratios which provide predetermined and predictable burning rates when the particles are used as additives to propellants and explosives. These elongated metal (e.g. zirconium) particles are preferrably produced by the same metallurgical technique which is used for producing superconducting filaments in a copper matrix such as the type of filament generally described in a recent article by Valaris et al published at the Applied Super Conductivity Conference, August 1988, San Francisco. Since the filaments are all surrounded by a ductile metal matrix—such as copper, none of the filament are exposed to any exterior atmosphere environment. The total uniformity of each filament exceeds ±0.1 micron in diameter, as can be seen by the SEM pictures. Furthermore the filaments are solid, as opposed to powders. Therefore, these filaments can be safely handled-until ready to use. In use the copper matrix can be safely removed using HNO3. Since the filaments are under liquid, the acid can be flushed out and replaced by water safely and, in this way, the filaments never experience exposure to the atmosphere.

This process can be used to produce alloy filaments such as Niobium Titanium—This can also be used to produce composite filaments where the surface can be one metal while the core is another. For example the core can be Zirconium with an Aluminum surface or Zirconium with a Niobium surface where the Niobium would have lower ignition properties than Zirconium. The reverse could be used where the Niobium could be the core and the heat of combustion would be high. The heat of combustion of Niobium is −460,000 g-cal/mol as compared to Zirconium of 262,980 g-cal/mol. Thus various combinations of metals can be combined to give the most desired performance.

The fact that filaments are produced is a significant advantage in it's use for rocket fuels. The filaments, either continuous or chopped filaments, can be used to reinforce the normal rocket propellant which can crack or deform during use or as a result of aging.

These filament forming techniques have been widely used as described in numerous patents such as Roberts U.S. Pat. No. 3,698,863. Additional modifications of the above technology have been employed for the manufacture of metal filaments as illustrated in Webber et al U.S. Pat. Nos. 3,277,564; 3,379,000 and Roberts 3,394,213 and Yoblin 3,567,407. All of these processes will produce metal filaments of controlled and uniform cross section. Several patents dealing with the capacitor art, such as Douglass U.S. Pat. Nos. 3,742,369 and Fife 4,502,884 describe metalic compacts of valve metal powder (which may include titanium and zirconium) impregnated with a softer metal such as copper which are then reduced in size to form valve metal fibers of small cross sections. However, these processes, while useful for capacitor purposes, do not provide uniform fiber diameters.

SPECIFIC DESCRIPTION OF THE INVENTION

Example I

In one preferred embodiment of the invention the following steps were employed.

The procedure described by Roberts U.S. Pat. No. 3698,263 is used to produce zirconium filaments of 2.5 micron diameter (cross-section). These filaments were chopped to a length of about 1 centimeter and then added to the following formulation to provide a rocket propellant fuel:

| Component | Wt % |
|---|---|
| Double Based Nitrocellulose and nitroglycerin | 45% |
| Ammonium perchlorate | 35% |
| Zirconium filaments | 20% |

EXAMPLE II

The filaments of Example I were added to the following formulation to provide an explosive:

| Component | Wt % |
|---|---|
| RDX | 21% |
| Ammonium Nitrate | 21% |
| TNT | 40% |
| Zirconium filaments | 18% |

The basic propellant and explosive formulations are those in ASM Vol. 7 "Powder Metal Handbook" (1984) pp 600–601, While preferred embodiments of the invention have been described above numerous modifications thereof may be employed. For example, the resultant elongated zirconium filament may be produced in hexagonal cross section as described in the Valaris et al article or may be partially flattened during final processing operations, but in any case, the principal requirement of the processing steps is that the resultant filaments have a controlled and known surface to volume ratio which is independent of length.

When the metal filament is one formed of a metal other than zirconium it can be produced using the same mechanical working techniques. In fact, niobium titanium superconducting filament produced in accordance with the above-mentioned prior patents can be used as propellant additives after removal of the copper matrix usually employed.

An additional advantage of the use of the highly combustible metal filaments is that they serve as reinforcements to the propellant mix, thus permitting the propellant to better withstand high G forces and high temperatures.

The filaments can also be provided with coatings or cores to lower or raise the heat of combustion of the filaments, to lower or raise the melting point, or modify the ignition temperature of the filament.

The filaments can also be produced by the method described by McDonald in U.S. Pat. No. 4414428 wherein a mesh of the reactive metal is formed in Jelly roll with a layer of copper to provide a structure that can be reduced to form filaments of substantially uniform cross section throughout most of their length.

EXAMPLE 3

In this case the procedures used for manufacturing fine filaments are essentially those as described in the above-mentioned Valaris et al article and the filaments were a niobium-titanium alloy containing 53.5 percent niobium and 46.5 percent by weight titanium. These filaments were produced by drawing to a final diameter of about 3 microns. When these filaments were installed in a formulation of a propellant and the filaments were incorporated so as to be parallel to the direction of burning of the propellant it was found that the burning rate was increased due to the thermal conductivity of the filaments which raised the temperature of the unburned adjacent propellant in the body beyond the advancing flame front. Increases in rate of combustion of more than three times have been measured with the addition of the filaments.

During combustion, the actual burning mechanism can be quite complicated. After ignition and as burning proceeds at the flame front, the remaining charge can experience significant rise in both temperature and pressure. This can result in ignition instabilities and random and erratic explosion which would seriously reduce the effective overall performance of the device. With the presence of metallic filaments or ribbons, because of the mass and the specific heat of the metal, the temperature and temperature gradients are reduced. The contributing factor probably is the fact that continuous metallic filaments (on the order of 3 micron size) were used in the wire in un-cut condition and the thermal conductivity of these filaments created a path where the flame front could progress faster than before. Universal propellant components and, in general, organic compounds are not very conductive in nature. The continuous filament offers a path by which the heat necessary to create the flame front can travel and not be limited by the burning characteristics of the normal propellant mixture.

In the specific experiment, a strand of 0.040" diameter wire with 23,000 individual filaments of niobium-titanium was placed in a glass tube and the copper etched away. Still in the same orientation, the filaments were dried and impregnated with normal pyrotechnic components to create a rope-like structure (i.e. oxidizer, binder and polymer) dried and cured to form the structure. Lengths about 1–2 inch were cut and ignited and rates of combustions were measured. Even further improvement can be expected with optimization of the various components and method of preparation.

Previously, it has been reported that wires of various metals have been used in this application. However, these were wires of much larger size, approximately 0.010"–020" (250 microns–500 microns) and were not effective in increasing combustion rate. The fine filaments of the instant process have shown substantial improvement.

Another fact of importance is the ability to produce a propellant with superior speed of combustion in one direction as opposed to the case of fine powders. The anisotropy of the burn direction can be used to a significant advantage for rockets and gun propellants. One must also consider that for powders of metal to burn, since they are not connected, each particle must be separately ignited, where the filaments of the present invention would burn continuously from one end of the filament to the other. The flame front would advance in the same direction as the filaments with the filaments perpendicular to the flame front.

During combustion, surface burn occurs. In the case of filaments, the preferred direction is parallel to the filaments or "Z" axis.

The burning, in the case of powder, is isotropic and can burn in any direction, which may or may not be desirable. The filaments of the present invention could prevent burning in any direction but the one wanted.

The reported thermal conductivity of niobium-titanium filaments is in the order of 0.1 watts/M °K at room temperature. The other components are essentially insulators in comparison to this high conductivity.

Another subject of importance is Low Vulnerability Ammunition (LOVA) to resist premature ignition from thermal or electro magnetic sources. As compared to the case where fine powders of metals, for example aluminum, are used, this problem is a serious limitation. By the use of the present controlled filaments, variability in particle sizes and therefore variability in ignition characteristics are eliminated.

By suitable selection of the largest filament one can select the ignition temperature and ignition system for the best performance.

Further improvement can be made using a metallic coating on the filaments which can reduce its sensitivity to premature ignition. For example, niobium or tantalum coated zirconium filaments should be less sensitive to premature ignition. The niobium and tantalum coating would also act as a diffusion barrier as mentioned above, to copper zirconium compound formation.

One of the major problems in the production and use of fine metal powders is their extremely high pyrophoric nature. Indeed this has greatly limited their usefulness for many applications. This is especially true in the case of zirconium and hafnium. The present invention, which provides metal filaments, both continuous and of high uniformity, when made using a ductile matrix essentially removes this difficulty.

Equally important is the fact that one can maintain the chemical purity of the metals by shielding the filaments from atmospheric contaminants almost completely from ingot to filament fabrication. The chemical, combustion properties are not compromised and free and complete reactions which are reproducible and reliable are now possible in large scale application. The dangers are greatly reduced.

In order to obtain the maximum rate of combustion, a complete, uniform ignition of all the metal fuel and oxidants may be desired. Generally, in ignition, this often occurs at one point in the charge and then progresses into the charge until it is completely consumed or combustion occurs. This can be substantially improved by the use of continuous metallic fibers. An example is as follows:

Single or multiple strands are impregnated with oxidants and binder. The ends of these fibers can be left with the copper matrix intact. By applying an electric current into this metallic fiber bundle, electric resistance heating will occur such that the temperature can be rapidly increased along these fiber bundles. In this way, the entire charge can be simultaneously ignited.

The electric charge can be extremely rapid to create an even more rapid ignition rate, i.e. high pulse rate current application.

EXAMPLE 4

In this example the filaments of Example 3 were further reduced to the point where the average diameter was 1 micron.

Normally, the smaller the filament diameter the less ductility in the metal. Filaments between 2–20 microns are fairly simple to produce. To make sub-microns requires greater care. For example, use of high purity (low $O_2$, N2 C) starting metal, use of frequent anneals and use of diffusion barrier metals (Nb or Ta) to avoid interfacial compound formation. By using a combination of all of the above, continuous, uniform filaments have been produced.

By continuing the drawing beyond the above 2 micron range and by controlling exactly the variable of cold reduction, matrix ductility and filament dispersion, one can create a condition where the filaments not only give sub-micron filament sizes but also can produce a controlled filament separation which eliminates the need to cut or chop the filaments for application as fuels. As the percent of cold work increases, the ductility decreases such that the continuous filaments become discontinuous; this is done in a controlled fashion.

As the filament size is reduced by drawing, each filament, as it reaches a sub-micron size, will start to separate. The wire, having a "uniform" filament dispersion already in the 1–20 micron range will continue to be drawn down without wire breakage—because they are now so small that (even when the individual filaments separate), they will not break and can be compared to a dispersion strengthened composite.

Normally, this sub-micron particle . . . as different from continuous, uniform filaments would be extremely pyrophoric and dangerous to handle. This is not a problem when one uses a copper matrix which avoids exposure to atmospheric oxygen and nitrogen during manufacturing. As the copper is removed with acid ($HNO_3$) it is covered with liquid and it is only used when needed.

The process now produces "super-fine" particles all below the sub-micron range. This should result in extremely rapid combustion rates and more complete combustion efficiency than in the case of larger filaments.

As mentioned previously, the filaments do not have to be round, in fact, as produced in the Valaris et al. process, they are hexagonal. They can be flattened and can be produced during the whole processing in the form of flat foils. For example, interspersed layers of copper sheet and zirconium sheet can be stacked up to produce a composite multilayer sandwich, the outer two layers of which preferably comprise copper. When this sandwich is reduced by rolling through many steps, during which the product may be restacked upon itself many times, the final rolling steps can be a sandwich of literally hundreds of layers. When the sandwich is reduced to a final thickness, for example in a Sendzimir ("Z") rolling mill, it will have a total thickness of only 50 microns. In this case, the individual layers are on the order of 0.1 microns and the resultant product, when slit to narrow filaments will produce ultra-fine, ribbon-like layers of zirconium interspersed with copper of only 0.1 micron thick. Since a 3 micron powder size is equal to a 1 micron thick ribbon in surface to volume ratio, the thinner ribbons correspond, in surface to volume ratios, to even finer powders.

One can eliminate the need to slit the thin composite foil and also improve the rate of removal of the copper matrix. This can be done using an expanded mesh in place of a solid sheet of Zr, Nb, Ti, or Hf. If this composite, made of alternate layers of mesh and copper, is rolled then the width of the expanded mesh web remains the same during rolling. Thus, one can produce ribbons with widths as narrow as "0.005–0.015" range. This open area can also be controlled to permit much more useful metal in the overall composite while still allowing enough spacing in acid removal of copper between ribbons and each layer of expanded mesh.

In this way wider composites can be produced which would increase the yields and lower the overall manufacturing cost and without a separate slitting operation. In this case we are rolling as compared to extrusion and wire drawing. The combination of extrusion and drawing can also be done.

This would allow greater continuous ignition since now all of these ribbons are inter-connected periodically along their length.

Numerous other methods of producing such fine ribbons, such as by starting with a jelly roll of copper and zirconium or other reactive metal, can equally be used. These techniques are well-known in the superconductor manufacturing field. Examples of such metallurgical techniques are shown in the U.S. patents to Roberts and McDonald, previously cited.

I claim:

1. The process of forming a propellant or other explosive device which comprises adding to the normal organic propellant oxidizer a substantial weight of metal filaments from the group consisting of Aluminum, Zirconium, Titanium, and Niobium and alloys thereof having predetermined substantially uniform surface to volume ratios, the metal filaments having at least one dimension less than 10 microns, the filaments extending generally in the direction of desired flame propagation.

2. The process of claim 1, wherein the filament has the length-to-diameter ratio of at least 1000.

3. The process of claim 1, wherein the filament has a cross-sectional dimension of less than 1 micron.

4. The product of claim 1, wherein the surface-to-volume ratio is in excess of 100 square millimeters per cubic millimeter.

5. The process of claim 1 wherein the filaments are formed by superposing layers of the reactive metal and a second ductile metal and reducing the layers of reactive metal to a thickness less than 10 microns.

6. The process of claim 5 wherein the reactive metal layer is an open mesh.

7. An explosion device such as a propellant comprising a normal organic propellant and oxidizer and a substantial weight of metal filaments from the group consisting of Aluminum, Zirconium, Titanium, and Niobium and alloys thereof having predetermined substantially uniform surface to volume ratios, the metal filaments having at least one dimension less than 10 microns, the majority of said filaments extending from a first electrical contact region to a second electrical contact region, said filaments being coated with a high conductivity metal in the electrical contact regions and being free of said "HCM" throughout the remainder of the filament length.

* * * * *